US005351837A

United States Patent [19]

Smith

[11] Patent Number: 5,351,837

[45] Date of Patent: Oct. 4, 1994

[54] DISHWASHER RACK ASSEMBLY WITH FOLD DOWN COMBS

[75] Inventor: John M. Smith, Louisville, Ky.

[73] Assignee: General Electric Company, Louisville, Ky.

[21] Appl. No.: 116,573

[22] Filed: Sep. 7, 1993

[51] Int. Cl.[5] ..... A47F 5/00

[52] U.S. Cl. ..... 211/41; 211/181; 312/311; 220/488

[58] Field of Search ..... 211/41, 181, 184; 312/311, 312; 220/488

[56] References Cited

U.S. PATENT DOCUMENTS

| | | | |
|---|---|---|---|
| 2,997,155 | 8/1961 | Muckler et al. | 220/488 X |
| 3,752,322 | 8/1973 | Fiocca et al. | 211/41 |
| 3,934,728 | 12/1976 | Guth | 220/488 X |
| 4,046,261 | 9/1977 | Yake | 211/41 |
| 4,226,490 | 10/1980 | Jenkins et al. | 212/311 X |
| 4,449,765 | 5/1984 | Lampman | 312/311 |
| 4,606,464 | 8/1986 | Jordan et al. | 211/41 |
| 4,917,248 | 4/1990 | Friskney | 211/41 |
| 5,158,185 | 10/1992 | Michael et al. | 211/41 |

*Primary Examiner*—Robert W. Gibson, Jr.
*Attorney, Agent, or Firm*—H. Neil Houser

[57] ABSTRACT

A dishwasher rack assembly includes a first elongated rod extending across the rack bottom in one direction and a second elongated rod extending across the rack bottom and crossing the first rod at an angle. A comb includes a base rod overlying the first elongated rod and a finger projecting outward of the base rod. A connector includes a first pair of spaced apart walls forming a first downwardly open recess receiving the rods in a vertical array; a second pair of spaced apart walls forming a second downwardly open recess receiving the second elongated rod; and a third set of spaced apart walls forming a laterally open recess intersecting the first and second recesses and receiving the finger so that the comb can be moved between a position with the finger extending upward and a position with the finger lying parallel to the first and second rods.

12 Claims, 2 Drawing Sheets

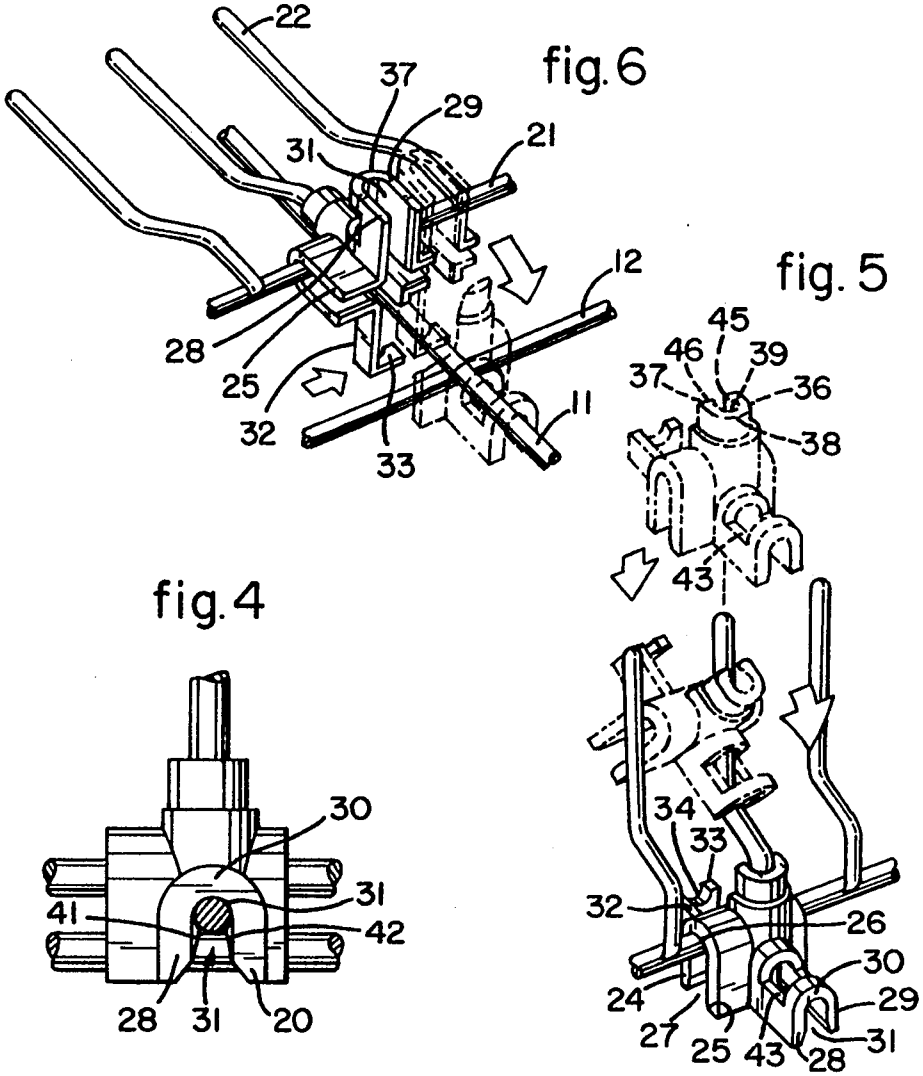
fig. 6
fig. 5
22
21
29
37
31
28
25
32
33
12
11
45
46
39
36
38
43
26
30
29
31
28
43
25
27
24
32
34
33
fig. 4
30
31
42
20
31
28
41
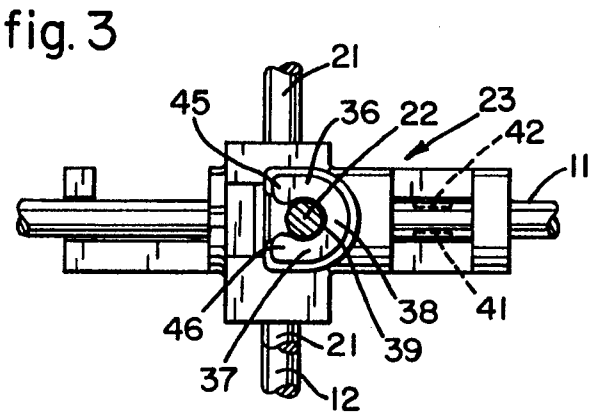
fig. 3
11
42
23
41
22
38
39
36
21
21
12
45
46
37
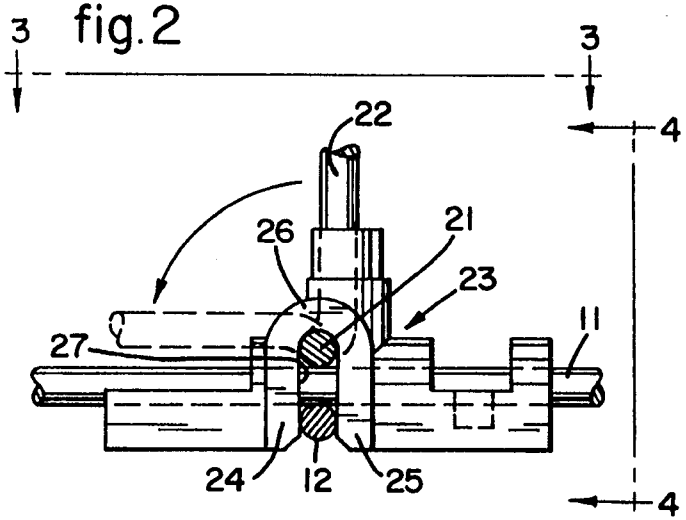
fig. 2
3
3
4
4
11
21
23
22
25
12
26
24
27

DISHWASHER RACK ASSEMBLY WITH FOLD DOWN COMBS

BACKGROUND OF THE INVENTION

This invention relates generally to rack assemblies for use in domestic dishwashers, that is dishwashers intended primarily for use in homes. Such dishwashers normally include two racks to support items to be washed in such as dishes, glasses, bowls and cooking utensils for example. Often an upper rack is disposed close to the top of the washing chamber and is used to hold glasses, cups and other small items. Typically the lower rack is positioned near the bottom of the chamber and a considerable distance below the upper rack. This provides vertical clearance to place dishes and platters on edge and to place food preparation bowls and pots up-side-down on the lower rack for washing. Each rack normally is supplied with an array of spaced apart, generally vertical tines or fingers which support and separate the individual items. The optimum spacing between adjacent tines for supporting thin items like dishes is much less than for supporting thick items like mixing bowls and pans. Thus any fixed array of tines is less than optimum for all possible combinations of items to be washed.

There have been numerous suggestions for arrangements to provide adjustable tines for user flexibility. U.S. Pat. Nos. 3,126,098, 3,269,548, 3,402,975, 3,752,322, 4,046,261 and 4,606,464 are examples of such suggestions.

More recently, U.S. Pat. No. 4,917,248 showed and described an arrangement with journals which hold a fence in the upper rack of a dishwasher so that the fence can be moved between a position with its projecting wires vertical and a position with its projecting wires generally horizontal. However, upper racks generally have their base wires bent at various locations along their lengths and the journals of this patent must be mounted at such a bend. In addition, the fence must be moved longitudinally to free the corresponding projecting wires before the fence can be rotated to move the projecting wires from their vertical to their horizontal positions.

The bottom racks of domestic dishwashers tend to be essentially planar with crossing longitudinal and lateral wires or rods forming an open mesh bottom wall. There is a need for a mechanism or assembly which is useful in such generally planar racks and which provides the user with ease of adjustment.

It is an object of this invention to provide an improved rack assembly for a dishwasher including connectors that mount to the crossing rods of a planar rack and support a comb withprojecting fingers for simple rotational movement of the comb between a fingers vertical position and a fingers horizontal position.

SUMMARY OF THE INVENTION

In accordance with one embodiment of this invention there is provided a dishwasher rack assembly including a plurality of first elongated wires extending in a first direction in parallel, spaced apart relationship and plurality of second elongated wires extending in parallel, spaced apart relationship and generally perpendicular to the first wires to form a horizontal bottom wall. A comb includes an elongated base wire and a plurality of finger wires extending generally perpendicularly from the base wire. At least two connectors are positioned at selected junctions of the first and second wires. Each of the connectors includes a first elongated channel receiving a first wire, a second wire and the comb base wire; a second elongated channel receiving the second wire; and a third channel, perpendicular to both the first and second channels, and receiving a corresponding finger wire of the comb.

BRIEF DESCRIPTION OF THE DRAWINGS

FIG. 2 is a fragmentary elevational view as seen along the line 2—2 in FIG. 1;

FIG. 3 is a fragmentary plan view as seen along line 3—3 in FIG. 2;

FIG. 4 is a fragmentary elevational view as seen along line 4—4 in FIG. 2;

FIG. 5 is a fragmentary perspective view of a part of the assembly of FIG. 1, illustrating a method of mounting a connector to a comb; and FIG. 6 is a fragmentary perspective view similar to FIG. 5, but illustrating a method of mounting a comb and connector to a rack.

DETAILED DESCRIPTION OF PREFERRED EMBODIMENT

Figure 1:
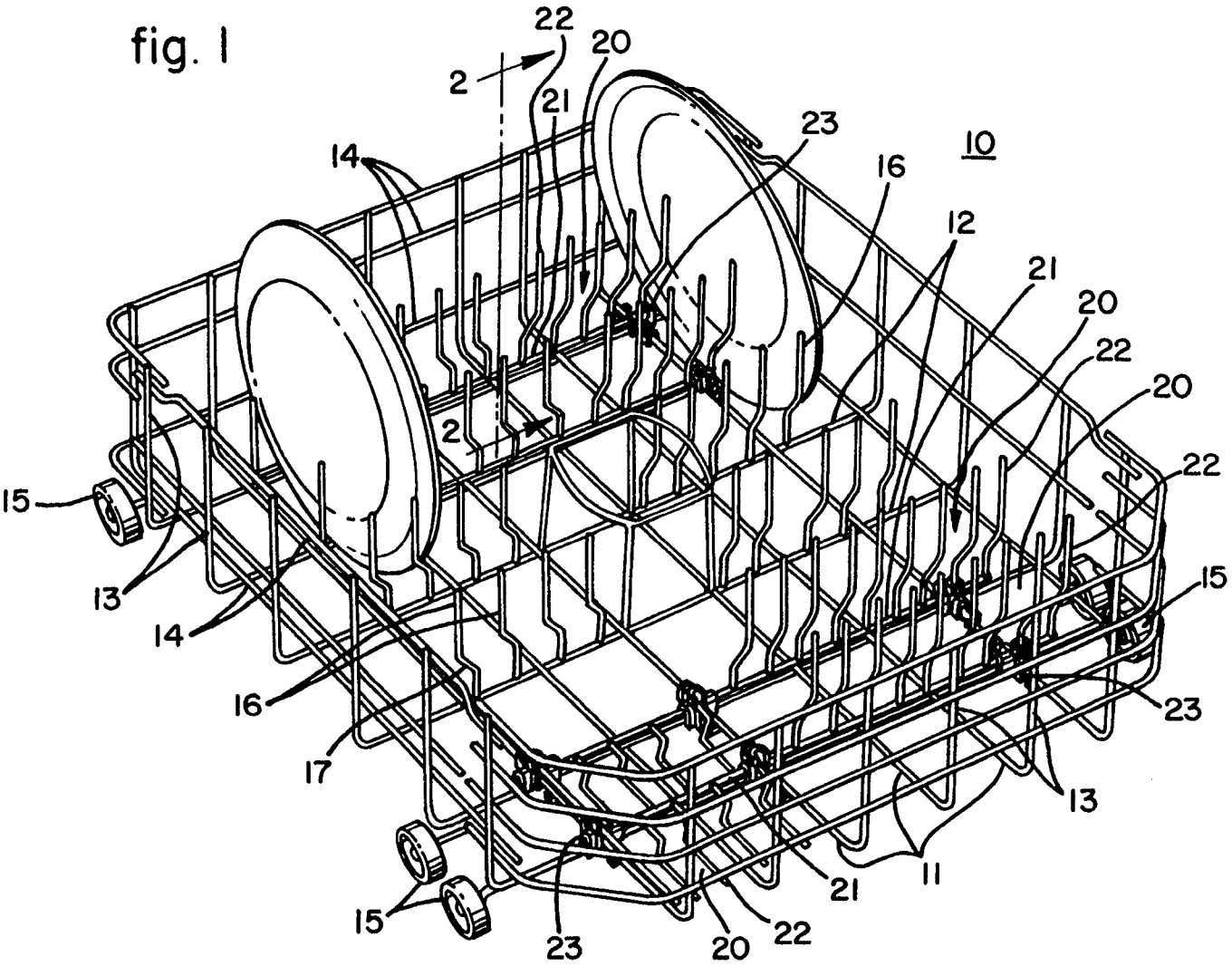
FIG. 1 is a perspective view of a dishwasher rack assembly incorporating one embodiment of the present invention.

Referring now to the drawings, and particularly to FIG. 1, there is shown a lower rack assembly 10 for a domestic dishwasher. The rack assembly 10 has a reticulated or open network construction so that wash and rinse liquid sprayed into the dishwasher chamber can freely impinge upon the items supported upon the rack and drain back into the bottom of the chamber. More particularly, the bottom wall of the rack is formed of spaced apart longitudinal rods or heavy wires 11 joined to spaced apart lateral rods or heavy wires 12 which extend generally perpendicular to the longitudinal rods. The end portions of the rods 11 and 12 are bent to form upwardly extending rods or wires 13, defining an enclosing lateral wall. Horizontal rods or wires 14 extend around the lateral wall and are joined to the upwardly extending rods 13 to stiffen the lateral walls. Preferably the rods or wires 11–14 are formed from heavy gauge metal wires or rods which are welded together into the basket configuration and then coated with a suitable plastic material to protect the rack from rusting and to prevent fragile glass items from resting on or hitting against hard metal. However, it will be understood that the rack may be constructed from other materials. For example, the rack can be molded as an unitary structure from a suitable plastic material such as polypropylene, for example. In that event, the wires or rods would be of a plastic material.

Wheels 15 are connected to the lower sides of the rack 10 to support it in the dishwasher. As is well known in the art, two set of wheels are provided at the front of the rack (that is to the lower right in FIG. 1) to assure that the front is always supported and does not get jammed in the opening between the chamber and door, as the rack is moved into and out of the wash chamber.

A network of vertical fingers or tines 16 extend upwardly from the bottom wall and preferably from the junctions of the longitudinal and lateral rods 11–12. The fingers conveniently are made of the same material as the wires or rods 11–14. The fingers serve to keep individual items in the rack separated and in the appropriate orientation to be washed. To this end the fingers 16 are generally vertical; however they may be canted from a strictly vertical position and may include offsets such as that shown at 17 to better support dishes or other items of various sizes and thicknesses.

It often is desirable to have the tines or fingers arrayed throughout the rack, as when a load of dishes includes many plates and saucers. On the other hand there are times when it is more advantageous to have part of the tines or fingers not extend upward from the bottom of the rack. For example, the tines tend to interfere with optimum loading of heavy bowls or thick pans or casserole dishes. Also, often the tines are omitted from an area of the rack to provide space for a flatware basket. If that basket is not needed for a particular washing operation, it would be advantageous to provide tines in that area to support other items.

To that end the present invention, in a preferred embodiment, omits the stationary tines 16 from selected areas of the rack and provides combs 20, each of which is formed with an elongated base wire or rod 21 having a number of fingers or tines projecting generally perpendicular thereto. The combs preferably are formed from the same materials as the rods of the rack. Each comb is mounted to the rack by connectors 23 so as to be movable between a first position, in which its tines 22 project generally vertically to the bottom of the rack, and a second position, in which its tines 22 lie generally along the bottom of the rack. Preferably the combs are formed so that they can be mounted in the rack with a finger adjacent each end of the comb positioned adjacent a junction of a longitudinal and a lateral rod of the rack bottom wall. Preferably each comb is mounted to the rack by at least a connector adjacent each end of the comb, and, if the comb is particularly long, one or more additional connectors can be positioned intermediate the ends of the comb.

Referring now particularly to FIGS. 2–4, the connector 23 conveniently is a unitary part molded from a suitable plastic material such as acetal for example. The connector 23 includes a first pair of spaced apart walls 24, 25 joined by an arch 26 to form a downwardly open elongated channel or recess 27. The connector also includes a second pair of spaced apart walls 28, 29 joined by an arch 30 to form a second downwardly open elongated recess or channel 31. The second pair of walls 28, 29 extend perpendicular to and away from the wall 25 so that the second channel 31 intersects the first channel at a right angle. An arm 32 extends perpendicular to and away from wall 24 generally in line with wall 28. A tang 33 is formed at the distal end of arm 32 and includes a semicircular recess 34. A third pair of spaced apart walls 36, 37 are joined by an arch 38 to form a third elongated recess or channel 39. Third channel 39 is laterally open and extends perpendicular to both of channels 27 and 31 at their juncture.

In the illustrative rack assembly of FIG. 1, the combs are mounted to the rack bottom overlying and parallel to lateral rods 12. A connectors 23 is assembled to a comb 20 and selected elongated rods 11, 12 to mount the comb 20 to the rods 11, 12. The lateral rod 12, longitudinal rod 11 and comb base rod 21 are received in recess 27 in a vertical array in that order (see FIG. 2). The longitudinal rod 11 also extends through the second channel 31 and overlies the tang 33, fitting in the semi-circular recess 34. A finger wire or tine 22 is received within the third recess 39.

Each of the connectors 23 is formed with detents to secure the connector to the elongated rods 11, 12 and to releasably secure a tine 22 in recess 39. More particularly, as best seen in FIG. 2, the walls 24, 25 converge slightly toward their distal ends so that their distal or outer ends form a detent securing the lateral rod 12, and thus also securing the other rods in the channel 27. A pair of ledges 41, 42 are formed on the inside of walls 28, 29 and form a detent securing the longitudinal rod 11 in the upper portion of channel 31. For ease of manufacture, a portion of the walls 28, 29 and arch 30 adjacent the ledges 41, 42 is omitted, as indicated at 43. Finally the distal ends of walls 36, 37 are formed as inwardly projecting lips 45, 46, defining a detent to releasably secure a corresponding finger rod or tine 22 in the recess 39.

The connectors securely but removably hold the comb to the elongated rods 11, 12. In addition they removably secure the corresponding tines in the channels 39 so that, when the tines are in their generally vertical positions, they support items to be washed with out risk of the comb rotating under the weight of the items and the force of the water. At the same time the user can manually rotate the comb to move the tines from a generally vertical position to a generally horizontal position, in which they closely overlie the rods 11, 12.

The illustrative rack assembly of FIG. 1 illustrates two separate comb lengths, that is some extend completely across the rack while others are in pairs, with each extending half way across the rack. It will be understood that combs can be provided in other configurations and lengths if desired.

Referring now to FIG. 5, in mounting or assembling a comb 20 and connector 23 to a pair of rods 11, 12, first the connector is slid over the tine 22 with the tine extending through the channel 39 until the comb base rod or wire 21 is fully seated against the arch 26 of channel 27. Referring now to FIG. 6, the comb is then positioned adjacent the rods 11, 12 with the arm 32 of the connector extending downward and with its tang 33 at the side of and extending toward the rod 11. The comb and connector are moved laterally (to the right in FIG. 6) to align the recess 31 and tang 33 with the rod 11 and to align the recess 27 with the rod 12. Finally the connector and comb are rotated and pushed toward the rods 11, 12 to seat the rod 11 in the top of recess 31, above the detent formed by ledges 41, 42 and overlying recess 34 in tang 33 and to seat the rod 12 in recess 27 above the detent formed by the distal ends of the walls 24, 25. It will be understood that it is easiest to mount a comb and all of its associated connectors to corresponding pairs of elongated rods 11, 12 at one time.

What is claimed is:

1. A dishwasher rack assembly comprising:

a plurality of first elongated wire members extending in parallel spaced apart relationship and a plurality of second elongated wires extending generally perpendicular to said first wires in parallel spaced apart relationship and secured to said first wires to form a generally horizontal bottom wall;

a comb including an elongated base wire and a plurality of finger wires attached to said base wire and projecting generally at right angles thereto;

at least two connectors positioned at selected junctions of said first and second wires; each of said connectors including a first elongated channel receiving a portion of said first elongated wire, a portion of said second elongated wire and a portion of said comb base wire; a second elongated channel perpendicular to said first channel and receiving a portion of said second elongated wire; and a third elongated channel generally perpendicular to both said first and second channels and releasably receiving a portion of a corresponding one of said finger wires;

whereby said comb is securely mounted at a predetermined location in said basket bottom and is rotatable between a position in which said finger wires are substantially vertical and a position in which said finger wires are substantially horizontal.

2. A dishwasher rack assembly as set forth in claim 1, wherein: where said second channel of each connector fits over the corresponding portion of said second elongated wire to one side of the corresponding first elongated wire and said connector also includes a retainer finger positioned under that second elongated wire on the other side of the corresponding first elongated wire.

3. A dishwasher rack assembly as set forth in claim 1, wherein: each of said connectors includes detent means releasably securing the corresponding first elongated wire within its first channel.

4. A dishwasher rack assembly as set forth in claim 1, wherein: each of said connectors includes detent means releasably securing the corresponding second wire in its second channel.

5. A dishwasher assembly as set forth in claim 1, wherein; each of said connectors includes detent means releasably securing the corresponding comb finger wire within its third channel.

6. A dishwasher rack assembly as set forth in claim 1: wherein each of said connectors secures the corresponding second elongated wire between the corresponding first elongated wire and the corresponding comb base wire.

7. A dishwasher rack assembly comprising:

a first elongated rod extending across the bottom of said rack in a first direction, a second elongated rod extending across the bottom of said rack and crossing said first rod at an angle;

a comb including an elongated base rod overlying said first rod and a finger projecting outwardly of said base rod;

a connector including a first pair of spaced apart walls forming a first downwardly open recess receiving said first rod, said comb base rod and said second rod in a vertical array in that order; said connector also including a second pair of spaced apart walls forming a second downwardly open recess intersecting said first recess at an angle thereto and receiving said second rod; and a third set of spaced apart walls forming a laterally open recess intersecting said first and second recesses at an angle and receiving said finger.

8. A dishwasher rack assembly as set forth in claim 7, wherein: said first pair of walls includes a detent securing said first rod in said first recess.

9. A dishwasher assembly as set forth in claim 7, wherein: said second pair of walls includes a detent securing said second rod in its second recess.

10. A dishwasher assembly as set forth in claim 7, wherein: said third pair of walls includes a detent securing said finger in said lateral opening recess.

11. A dishwasher assembly as set forth in claim 7, wherein: said second pair of walls extend outwardly of one of said first pair of walls and said connector further includes an arm extending outwardly of the other of said first pair of walls and including a tang at its distal end underlying said second rod.

12. A dishwasher rack assembly as set forth in claim 7, wherein: said first and second rods cross at substantially right angles.

* * * * *